US009926811B2

(12) United States Patent
Giegel et al.

(10) Patent No.: US 9,926,811 B2
(45) Date of Patent: Mar. 27, 2018

(54) CONTROL METHODS FOR HEAT ENGINE SYSTEMS HAVING A SELECTIVELY CONFIGURABLE WORKING FLUID CIRCUIT

(71) Applicants: Joshua Giegel, Strretsboro, OH (US); Timothy Held, Akron, OH (US); Brett Bowan, Copley, OH (US); Cameron Close, Munroe Falls, OH (US)

(72) Inventors: Joshua Giegel, Strretsboro, OH (US); Timothy Held, Akron, OH (US); Brett Bowan, Copley, OH (US); Cameron Close, Munroe Falls, OH (US)

(73) Assignee: Echogen Power Systems, LLC, Akron, OH (US)

( * ) Notice: Subject to any disclaimer, the term of this patent is extended or adjusted under 35 U.S.C. 154(b) by 669 days.

(21) Appl. No.: 14/475,678

(22) Filed: Sep. 3, 2014

(65) Prior Publication Data

US 2015/0377076 A1 Dec. 31, 2015

Related U.S. Application Data

(60) Provisional application No. 61/874,321, filed on Sep. 5, 2013, provisional application No. 62/010,731, filed
(Continued)

(51) Int. Cl.
*F01K 7/40* (2006.01)
*F01K 25/08* (2006.01)
(Continued)

(52) U.S. Cl.
CPC ..... *F01K 7/40* (2013.01); *F01K 9/02* (2013.01); *F01K 23/12* (2013.01); *F01K 25/08* (2013.01); *F22D 1/32* (2013.01); *F01K 25/10* (2013.01)

(58) Field of Classification Search
CPC ..... F01K 25/08; F22D 1/32; H02K 7/18
See application file for complete search history.

(56) References Cited

U.S. PATENT DOCUMENTS 4,122,686 A * 10/1978 Lindahl ..... F25B 5/02 62/196.1
4,593,527 A * 6/1986 Nakamoto ..... B60H 1/00007 165/286
(Continued)

*Primary Examiner* — Mark Laurenzi
*Assistant Examiner* — Shafiq Mian

(57) ABSTRACT

Systems and methods for controlling a heat engine system are provided. One method includes initiating flow of a working fluid through a working fluid circuit having a high pressure side and a low pressure side by controlling a pump to pressurize and circulate the working fluid through the working fluid circuit and determining a configuration of the working fluid circuit by determining which of a plurality of waste heat exchangers and which of a plurality of recuperators to position in the high pressure side of the working fluid circuit. The method also includes determining, based on the determined configuration of the working fluid circuit, for each of a plurality of valves, whether to position each respective valve in an opened position, a closed position, or a partially opened position and actuating each of the plurality of valves to the determined opened position, closed position, or partially opened position.

18 Claims, 6 Drawing Sheets

Related U.S. Application Data on Jun. 11, 2014, provisional application No. 62/010,706, filed on Jun. 11, 2014.

(51) Int. Cl.

| | |
|---|---|
| ***F22D 1/32*** | (2006.01) |
| ***F01K 9/02*** | (2006.01) |
| ***F01K 23/12*** | (2006.01) |
| *F01K 25/10* | (2006.01) |

(56) References Cited

U.S. PATENT DOCUMENTS 4,876,856 A * 10/1989 Iishiki ..... F01D 15/005 60/651
5,638,673 A * 6/1997 Yabe ..... F01K 25/00 60/649
7,665,304 B2 * 2/2010 Sundel ..... F01K 15/04 60/671
8,567,193 B2 * 10/2013 Terashima ..... F01K 23/065 60/320
8,931,275 B2 * 1/2015 Glover ..... F02G 5/04 165/101
2009/0292436 A1 * 11/2009 D'Amato ..... G05B 13/048 701/100
2010/0205966 A1 * 8/2010 Matteson ..... F01K 13/02 60/646
2010/0287969 A1 * 11/2010 Ueda ..... F25B 1/053 62/324.6
2011/0056221 A1 * 3/2011 Woolley ..... F25B 41/00 62/118
2011/0088397 A1 * 4/2011 Mori ..... F01K 23/065 60/661
2011/0314818 A1 * 12/2011 Breen ..... F01K 25/10 60/676
2012/0047892 A1 * 3/2012 Held ..... F01K 3/185 60/652
2012/0192560 A1 * 8/2012 Ernst ..... F01K 23/065 60/616

* cited by examiner

CONTROL METHODS FOR HEAT ENGINE SYSTEMS HAVING A SELECTIVELY CONFIGURABLE WORKING FLUID CIRCUIT

CROSS-REFERENCE TO RELATED APPLICATIONS

This application claims the benefit of U.S. Prov. Appl. No. 61/874,321, entitled "Highly Efficient Heat Engine System with a Supercritical Carbon Dioxide Circuit" and filed Sep. 5, 2013; U.S. Prov. Appl. No. 62/010,731, entitled "Control Methods for Heat Engine Systems Having a Selectively Configurable Working Fluid Circuit" and filed Jun. 11, 2014; and U.S. Prov. Appl. No. 62/010,706, entitled "Heat Engine System Having a Selectively Configurable Working Fluid Circuit" and filed Jun. 11, 2014. These applications are incorporated herein by reference in their entirety to the extent consistent with the present application.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Therefore, waste heat may be converted into useful energy by a variety of turbine generator or heat engine systems that employ thermodynamic methods, such as Rankine cycles or other power cycles. Rankine and similar thermodynamic cycles are typically steam-based processes that recover and utilize waste heat to generate steam for driving a turbine, turbo, or other expander connected to an electric generator, a pump, or other device.

An organic Rankine cycle utilizes a lower boiling-point working fluid, instead of water, during a traditional Rankine cycle. Exemplary lower boiling-point working fluids include hydrocarbons, such as light hydrocarbons (e.g., propane or butane) and halogenated hydrocarbons, such as hydrochlorofluorocarbons (HCFCs) or hydrofluorocarbons (HFCs) (e.g., R245fa). More recently, in view of issues such as thermal instability, toxicity, flammability, and production cost of the lower boiling-point working fluids, some thermodynamic cycles have been modified to circulate non-hydrocarbon working fluids, such as ammonia.

One of the primary factors that affects the overall system efficiency when operating a power cycle or another thermodynamic cycle is being efficient at the heat addition step. Poorly designed heat engine systems and cycles can be inefficient at heat to electrical power conversion in addition to requiring large heat exchangers to perform the task. Such systems deliver power at a much higher cost per kilowatt than highly optimized systems. Heat exchangers that are capable of handling such high pressures and temperatures generally account for a large portion of the total cost of the heat engine system.

Therefore, there is a need for heat engine systems and methods for controlling such systems, whereby the systems and methods provide improved efficiency while generating work or electricity from thermal energy.

SUMMARY

In one embodiment, a heat engine system includes a pump configured to pressurize and circulate a working fluid through a working fluid circuit having a high pressure side and a low pressure side. A first expander is configured to receive the working fluid from the high pressure side and to convert a pressure drop in the working fluid to mechanical energy. A plurality of waste heat exchangers are disposed in series along a flow path of a heat source stream and each is configured to transfer thermal energy from the heat source stream to the working fluid. The heat engine system also includes a plurality of recuperators, each configured to transfer thermal energy from the working fluid flowing through the low pressure side to the working fluid flowing through the high pressure side, and a plurality of valves, each configured to be positioned in an opened position, a closed position, and a partially opened position. A valve controller is configured to actuate each of the plurality of valves to the opened position, the closed position, or the partially opened position to selectively control which of the plurality of waste heat exchangers is positioned in the high pressure side, which of the plurality of recuperators is positioned in the high pressure side, and which of the plurality of recuperators is positioned in the low pressure side.

In another embodiment, a method for controlling a heat engine system includes initiating flow of a working fluid through a working fluid circuit having a high pressure side and a low pressure side by controlling a pump to pressurize and circulate the working fluid through the working fluid circuit, determining a configuration of the working fluid circuit by determining which of a plurality of waste heat exchangers and which of a plurality of recuperators to position in the high pressure side of the working fluid circuit, and determining, based on the determined configuration of the working fluid circuit, which of a plurality of valves to position in a closed position to isolate a portion of the working fluid from the working fluid flowing through the working fluid circuit. The method also includes receiving data corresponding to a measured temperature and/or pressure of the working fluid flowing through the working fluid circuit, determining whether the measured temperature and/or pressure exceeds a predetermined threshold, and actuating, if the measured temperature and/or pressure exceeds the predetermined threshold, one or more of the plurality of valves positioned in the closed position to position the one or more of the plurality of valves in an opened position or a partially opened position to enable at least a portion of the isolated portion of the working fluid to flow through the working fluid circuit.

In another embodiment, a method for controlling a heat engine system includes initiating flow of a working fluid through a working fluid circuit having a high pressure side and a low pressure side by controlling a pump to pressurize and circulate the working fluid through the working fluid circuit, determining a configuration of the working fluid circuit by determining which of a plurality of waste heat exchangers and which of a plurality of recuperators to position in the high pressure side of the working fluid circuit, determining, based on the determined configuration of the working fluid circuit, for each of a plurality of valves, whether to position each respective valve in an opened position, a closed position, or a partially opened position, and actuating each of the plurality of valves to the determined opened position, closed position, or partially opened position.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
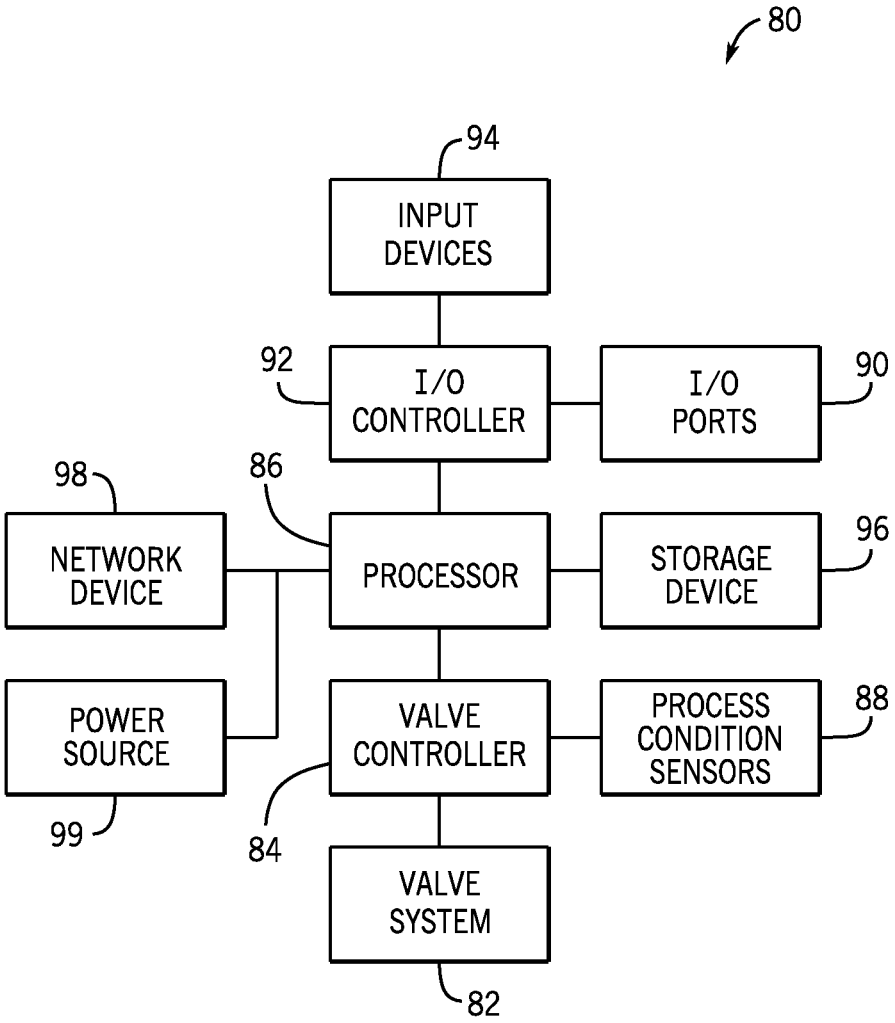
FIG. 1 is a block diagram of example components of an electronic control system for a heat engine system, according to one or more embodiments disclosed herein.
Figure 2:
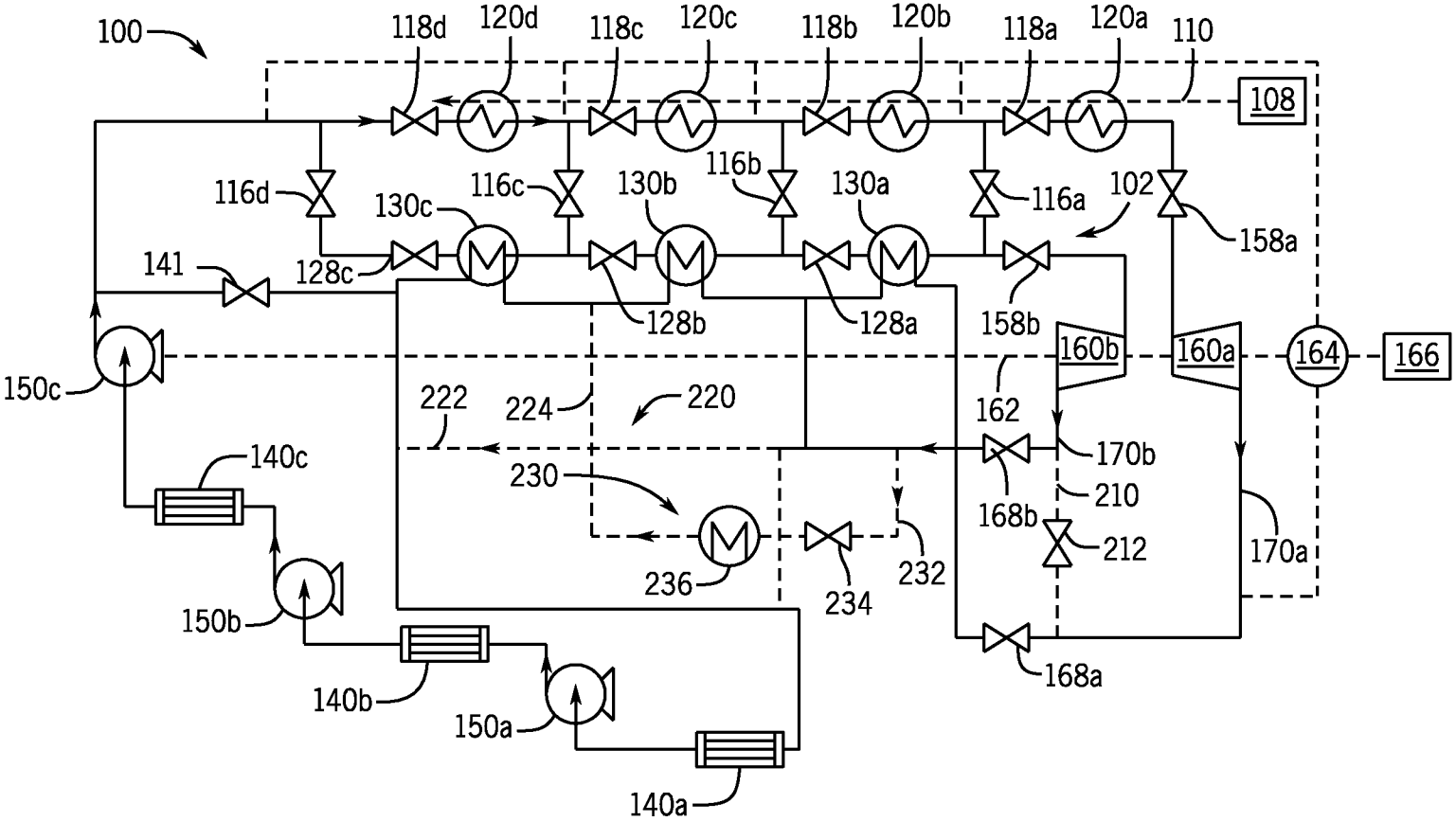
FIG. 2 illustrates a heat engine system having a selectively configurable working fluid circuit, according to one or more embodiments disclosed herein.

FIG. 1 is a block diagram of exemplary components of one embodiment of an electronic control system 80 that may control the operation of a heat engine system 100 depicted in FIG. 2. The electronic control system 80 includes a valve system 82 that may be used to selectively configure a working fluid circuit such that a working fluid may be routed through a selected quantity and type of fluid handling or processing components, which may depend on the given application. For example, in one embodiment, the valve system 82 may be used to selectively configure the working fluid circuit 102 shown in FIG. 2 such that a flow path of a working fluid may be established through any desired combination of one or more waste heat exchangers 120*a*, 120*b*, 120*c*, and 120*d*, and one or more recuperators 130*a*, 130*b*, and 130*c*, turbines or expanders 160*a* and 160*b*, one or more pumps 150*a*, 150*b*, and 150*c*, one or more condensers 140*a*, 140*b*, and 140*c*. In such an embodiment, the valve system 82 may include bypass valves 116*a*, 116*b*, 116*c*, and 116*d*, stop or control valves 118*a*, 118*b*, 118*c*, and 118*d*, stop or control valves 128*a*, 128*b*, and 128*c*, and stop or throttle valves 158*a* and 158*b*, each of which may be utilized in opened positions, closed positions, and partially opened or closed positions to selectively allow the working fluid to flow through the circuit 102.

A valve controller 84 may provide the infrastructure for receiving data from a processor 86 to selectively control the position of each of the valves in the valve system 82. For example, the valve controller 84 may include control logic for processing control commands from the processor 86 to produce one or more changes in the positions of each of the valves in the valve system 82. Once the control logic is processed, the valve controller 84 may selectively actuate each of the valves in the valve system 82 to position each of the valves in an opened position, a closed position, or a partially opened or closed position. In certain embodiments, the valve controller 84 may also include one or more integrated circuits and associated components, such as resistors, potentiometers, voltage regulators, drivers, and so forth. However, in other embodiments, the valve controller 84 may be integrated with the processor 86.

The valve controller 84 may also be responsive to data received from one or more process condition sensors 88. The process condition sensors 88 may include temperature sensors, pressure sensors, flow rate sensors, or any other sensors configured to measure a parameter of the working fluid circuit 102, the working fluid flowing therethrough, or parameters from other components in the system 100, such as temperatures, pressures, rotation speed, frequency, voltage, etc. In one embodiment, as discussed in more detail below with respect to FIG. 6, the valve controller 84 may continually respond to the process conditions measured by the process condition sensors 88 throughout operation to maximize the power output of the heat engine system 100. For example, the valve controller 84 may repeatedly adjust the position of each of the valves of the valve system 82 in response to the data from the process condition sensors 88 and/or data from the processor 86 to obtain the maximum possible power output of the heat engine system 100 given the current process conditions. In one embodiment of the system 100 the valve controller 84 may be configured to periodically adjust the position of valve system 82 to maximize working fluid flow and heat transfer in the heat exchangers and recuperators of system 100 under varying process conditions.

The processor 86 may include one or more processors that provide the processing capability to execute the operating system, programs, interfaces, and any other functions of the electronic control system 80, one or more microprocessors and/or related chip sets, a computer/machine readable memory capable of storing date, program information, or other executable instructions thereon, general purpose microprocessors, special purpose microprocessors, or a combination thereof, on board memory for caching purposes, instruction set processors, and so forth.

The electronic control system 80 may also include one or more input/output (I/O) ports 90 that enable the electronic control system 80 to couple to one or more external devices (e.g., external data sources). An I/O controller 92 may provide the infrastructure for exchanging data between the processor 86 and I/O devices connected through the I/O ports 90 and/or for receiving user input through one or more input devices 94.

A storage device 96 may store information, such as one or more programs and/or instructions, used by the processor 86, the valve controller 84, the I/O controller 92, or a combination thereof. For example, the storage device 96 may store firmware for the electronic control system 80, programs, applications, or routines executed by the electronic control system 80, processor functions, etc. The storage device 96 may include one or more non-transitory, tangible, machine-readable media, such as read-only memory (ROM), random access memory (RAM), solid state memory (e.g., flash memory), CD-ROMs, hard drives, universal serial bus (USB) drives, any other computer readable storage medium, or any combination thereof. The storage media may store encoded instructions, such as firmware, that may be executed by the processer 86 to operate the logic or portions of the logic presented in the methods disclosed herein.

The electronic control system 80 may also include a network device 98 for communication with external devices over a network, such as a Local Area Network (LAN), Wide Area Network (WAN), or the Internet and may be powered by a power source 99. The power source 99 may be an alternating current (AC) power source (e.g., an electrical outlet), a portable energy storage device (e.g., a battery or battery pack), a combination thereof, or any other suitable source of available power. Further, in certain embodiments, some or all of the components of the electronic control system 80 may be provided in a housing, which may be configured to support and/or enclose some or all of the components of the electronic control system 80.

FIG. 2 illustrates an embodiment of the heat engine system 100 having the working fluid circuit 102 that may be selectively configured by the electronic control system 80 such that a flow path of a working fluid is directed through any desired combination of the plurality of waste heat exchangers 120*a*, 120*b*, 120*c*, and 120*d*, the plurality of recuperators 130*a*, 130*b*, and 130*c*, the turbines or expanders 160*a* and 160*b*, the pumps 150*a*, 150*b*, and 150*c*, and the condensers 140*a*, 140*b*, and 140*c*. To that end, the bypass valves 116*a*, 116*b*, 116*c*, and 116*d*, the stop or control valves 118*a*, 118*b*, 118*c*, and 118*d*, the stop or control valves 128*a*, 128*b*, and 128*c*, and the stop or throttle valves 158*a* and 158*b* may also each be selectively positioned in an opened position, a closed position, or a partially opened or closed position to enable the routing of the working fluid through the desired components.

In one exemplary embodiment, the routing of the working fluid through various combinations of heat engine system 100 elements may be determined or selected by the user/operator. In another exemplary embodiment, the routing of the working fluid may be automatically determined by the electronic control system 80 based on one or more inputs, wherein the inputs represent system parameters such as characteristics of the heat source, requirements of the power generation system, ambient temperatures, etc. In the embodiment where the electronic control system 80 automatically determines valve positions, the determination may be based on predetermined system configurations, or alternatively, the valve controller 84 may make adjustments to the valve positions in an attempt to change a parameter of the heat engine system 100 (such as increase efficiency). In this embodiment, if the valve adjustments do not accomplish the desired change, then the valve controller 84 may make additional changes in a feedback or feed forward-type control arrangement.

The working fluid circuit 102 generally has a high pressure side and a low pressure side and is configured to flow the working fluid through the high pressure side and the low pressure side. In one selectively configurable embodiment of FIG. 2, the high pressure side may extend along the flow path of the working fluid from the pump 150*c* to the expander 160*a* and/or the expander 160*b*, depending on which of the expanders 160*a* and 160*b* are included in the working fluid circuit 102, and the low pressure side may extend along the flow path of the working fluid from the expander 160*a* and/or the expander 160*b* to the pump 150*a*. In some embodiments, working fluid may be transferred from the low pressure side to the high pressure side via a pump bypass valve 141.

Depending on the features of the given implementation, the working fluid circuit 102 may be configured such that the available components (e.g., the waste heat exchangers 120*a*, 120*b*, 120*c*, and 120*d* and the recuperators 130*a*, 130*b*, and 130*c*) are each selectively positioned in (e.g., fluidly coupled to) or isolated from (e.g., not fluidly coupled to) the high pressure side and the low pressure side of the working fluid circuit. For example, in one embodiment, the electronic control system 80 may utilize the processor 86 to implement the control logic shown in a method 250 illustrated in FIG. 3. In this embodiment, the processor 86 may receive data corresponding to one or more implementation-specific optimization parameters (block 252). For instance, the processor 86 may receive data from the input devices 94 (e.g., a user interface) via the I/O controller 92 regarding the type of the available heat source 108. In some embodiments, the implementation-specific optimization parameters may relate to or include the heat source 108, the location where the heat engine system 100 is utilized (e.g., on a ship, on land, etc.), the amount of power needed for a given application, the temperature of the surrounding environment, and so forth.

In accordance with the method 250, the processor 86 may further determine which of the waste heat exchangers 120*a*, 120*b*, 120*c*, and 120*d* to position in the high pressure side (block 254), which of the recuperators 130*a*, 130*b*, and 130*c* to position in the high pressure side (block 256), and which of the recuperators 130*a*, 130*b*, and 130*c* to position in the low pressure side (block 258). The processor 86 may make such determinations, for example, by referencing programs, lookup tables, references, sensor inputs, information stored on the storage device 96, or any combination of the above. Further, for each valve in the valve system 82, the processor 86 may determine whether the valve should be placed in an opened position, a closed position, or a partially opened or closed position (block 260). The processor 86 may further selectively open or close each of the valves in the valve system 82 to achieve the desired working fluid circuit configuration for the given implementation (block 262). In addition to the valve system 82 selecting the fluid circuit configuration, the valve system may also select the volume of fluid or flow rate through each leg or branch of the selected configuration, e.g., the valve system 82 may regulate the working fluid flow through selected elements of the selected configuration.

Figure 3:
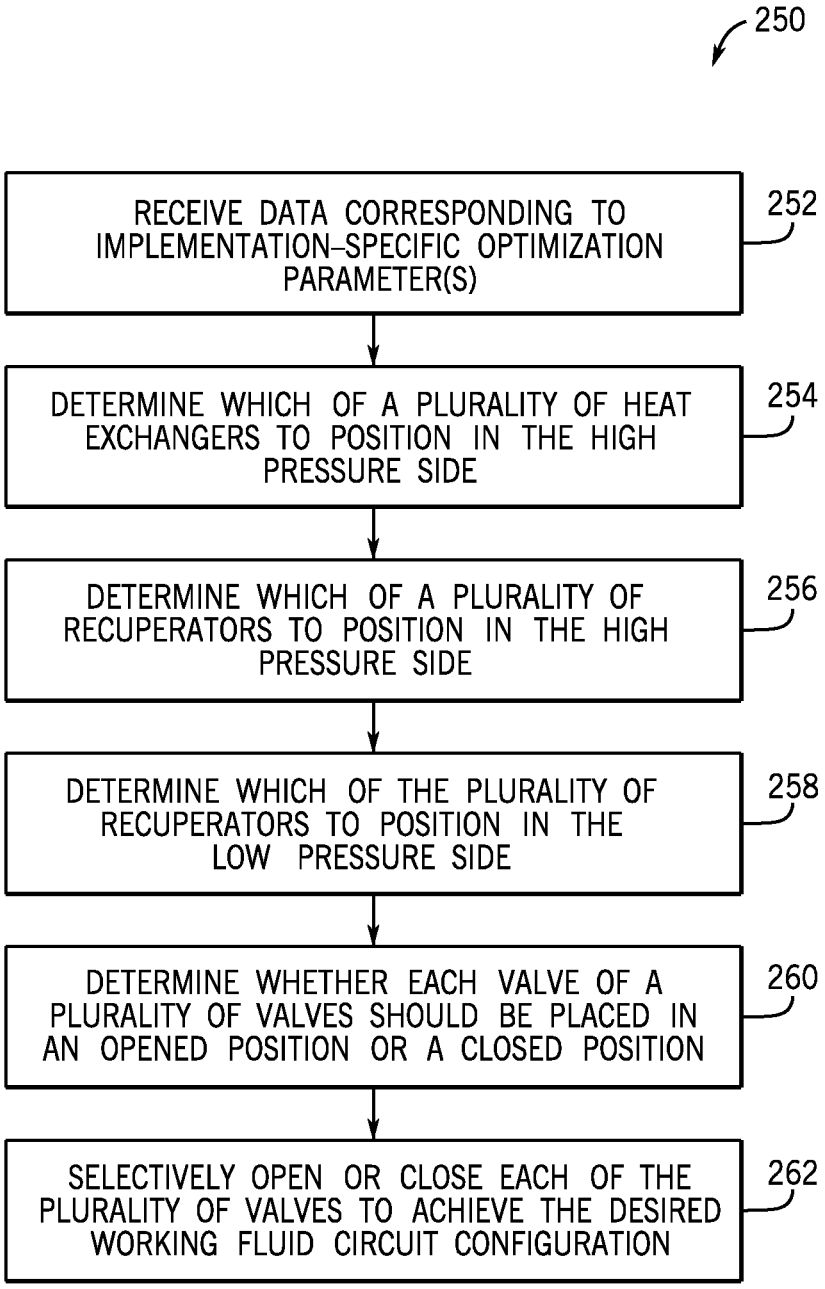
FIG. 3 is a flow chart illustrating a method for selectively configuring the heat engine system illustrated in FIG. 2, according to one or more embodiments disclosed herein.

It should be noted that in the embodiment of FIG. 3 described above, the method 250 is described for implementation by the processor 86. However, in other embodiments, any of the disclosed controllers or any other suitable controller may be used for this purpose. For example, in one embodiment, the valve controller 84 may provide the infrastructure for the processor 86 to implement the desired position changes to the valves in the valve system 82, or the valve controller 84 may implement the method 250 of FIG. 3. Further, the waste heat exchangers 120*a*, 120*b*, 120*c*, and 120*d* and the recuperators 130*a*, 130*b*, and 130*c* are merely examples, and in other embodiments, any number of waste heat exchangers and recuperators may be controlled in accordance with the method 250.

In some embodiments of the working fluid circuit 102 of FIG. 2, a turbopump may be formed by a shaft 162 coupling the second expander 160*b* and the pump 150*c*, such that the second expander 160*b* may drive the pump 150*c* with the mechanical energy generated by the second expander 160*b*. In such embodiments, in accordance with the method 250, the working fluid flow path from the pump 150*c* to the second expander 160*b* may be established by selectively fluidly coupling the recuperators 130*c* and 130*b* and the waste heat exchanger 120*b* to the high pressure side by positioning valves 116*d*, 128*c*, 128*b*, 116*b*, 118*b*, 116*a*, and 158*b* in an opened position. The working fluid flow path in this embodiment extends from the pump 150*c*, through the recuperator 130*c*, through the recuperator 130*b*, through the waste heat exchanger 120*b*, and to the second expander 160*b*. For example, the working fluid flow path through the low pressure side in this embodiment may extend from the second expander 160*b* through turbine discharge line 170*b*, through the recuperators 130*a*, 130*b*, and 130*c*, and to the condensers 140*a*, 140*b*, and 140*c* and the pumps 150*a*, 150*b*, and 150*c*.

Still further, in another embodiment in accordance with the method 250, the working fluid flow path may be established from the pump 150*c* to the first expander 160*a* by fluidly coupling the recuperator 130*c*, the waste heat exchanger 120*c*, the recuperator 130*a*, and the waste heat exchanger 120*a* to the high pressure side. In such an embodiment, the working fluid flow path through the high pressure side extends from the pump 150*c*, through the valve 116*d*, through the valve 128*c*, through the recuperator 130*c*, through the valve bypass 116*c*, through the stop or control valve 118*c*, through the waste heat exchanger 120*c*, through the bypass valve 116*b*, through the valve 128*a*, through the recuperator 130*a*, through the bypass valve 116*a*, through the stop or control valve 118*a*, through the waste heat exchanger 120*a*, through the stop or throttle valve 158*a*, and to the first expander 160*a*. The working fluid flow path through the low pressure side in this embodiment may extend from the first expander 160*a*, through the turbine discharge line 170*a*, through the recuperators 130*a*, 130*b*, and 130*c* and to the condensers 140*a*, 140*b*, and 140*c* and the pumps 150*a*, 150*b*, and 150*c*.

It should be noted that presently contemplated embodiments may include any number of waste heat exchangers, any number of recuperators, any number of valves, any number of pumps, any number of condensers, and any number of expanders, not limited to those shown in FIG. 2.—The quantity of such components in the illustrated embodiment of FIG. 2 is merely an example, and any suitable quantity of these components may be provided in other embodiments.

In one embodiment, the plurality of waste heat exchangers 120*a*-120*d* may contain four or more waste heat exchangers, such as the first waste heat exchanger 120*a*, the second waste heat exchanger 120*b*, the third waste heat exchanger 120*c*, and the fourth waste heat exchanger 120*d*. Each of the waste heat exchangers 120*a*-120*d* may be selectively fluidly coupled to and placed in thermal communication with the high pressure side of the working fluid circuit 102, as determined by the electronic control system 80, to tune the working fluid circuit 102 to the needs of a given application. Each of the waste heat exchangers 120*a*-120*d* may be configured to be fluidly coupled to and in thermal communication with a heat source stream 110 and configured to transfer thermal energy from the heat source stream 110 to the working fluid within the high pressure side. The waste heat exchangers 120*a*-120*d* may be disposed in series along the direction of flow of the heat source stream 110. In one configuration, with respect to the flow of the working fluid through the working fluid circuit 102, the second waste heat exchanger 120*b* may be disposed upstream of the first waste heat exchanger 120*a*, the third waste heat exchanger 120*c* may be disposed upstream of the second waste heat exchanger 120*b*, and the fourth waste heat exchanger 120*d* may be disposed upstream of the third waste heat exchanger 120*c*.

In some embodiments, the plurality of recuperators 130*a*-130*c* may include three or more recuperators, such as the first recuperator 130*a*, the second recuperator 130*b*, and the third recuperator 130*c*. Each of the recuperators 130*a*-130*c* may be selectively fluidly coupled to the working fluid circuit 102 and configured to transfer thermal energy between the high pressure side and the low pressure side of the working fluid circuit 102 when fluidly coupled to the working fluid circuit 102. In one embodiment, the recuperators 130*a*-130*c* may be disposed in series on the high pressure side of the working fluid circuit 102 upstream of the second expander 160*b*. The second recuperator 130*b* may be disposed upstream of the first recuperator 130*a*, and the third recuperator 130*c* may be disposed upstream of the second recuperator 130*b* on the high pressure side.

In one embodiment, the first recuperator 130*a*, the second recuperator 130*b*, and the third recuperator 130*c* may be disposed in series on the low pressure side of the working fluid circuit 102, such that the second recuperator 130*b* may be disposed downstream of the first recuperator 130*a*, and the third recuperator 130*c* may be disposed downstream of the second recuperator 130*b* on the low pressure side. The first recuperator 130*a* may be disposed downstream of the first expander 160*a* on the low pressure side, and the second recuperator 130*b* may be disposed downstream of the second expander 160*b* on the low pressure side.

The heat source stream 110 may be a waste heat stream such as, but not limited to, a gas turbine exhaust stream, an industrial process exhaust stream, or other types of combustion product exhaust streams, such as furnace or boiler exhaust streams, coming from or derived from the heat source 108. In some exemplary embodiments, the heat source 108 may be a gas turbine, such as a gas turbine power/electricity generator or a gas turbine jet engine, and the heat source stream 110 may be the exhaust stream from the gas turbine. The heat source stream 110 may be at a temperature within a range from about 100° C. to about 1,000° C., or greater than 1,000° C., and in some examples, within a range from about 200° C. to about 800° C., more narrowly within a range from about 300° C. to about 600° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

The heat engine system 100 also includes at least one condenser 140*c* and at least one pump 150*c*, but in some embodiments includes the plurality of condensers 140*a*-140*c* and the plurality of pumps 150*a*-150*c*. The first condenser 140*c* may be in thermal communication with the working fluid on the low pressure side of the working fluid circuit 102 and configured to remove thermal energy from the working fluid on the low pressure side. The first pump 150*c* may be fluidly coupled to the working fluid circuit 102 between the low pressure side and the high pressure side of the working fluid circuit 102 and configured to circulate or pressurize the working fluid within the working fluid circuit 102. The first pump 150*c* may be configured to control mass flow rate, pressure, or temperature of the working fluid within the working fluid circuit 102.

In other embodiments, the second condenser 140*b* and the third condenser 140*a* may each independently be fluidly coupled to and in thermal communication with the working fluid on the low pressure side of the working fluid circuit 102 and configured to remove thermal energy from the working fluid on the low pressure side of the working fluid circuit 102. Also, the second pump 150*b* and the third pump 150*a* may each independently be fluidly coupled to the low pressure side of the working fluid circuit 102 and configured to circulate or pressurize the working fluid within the working fluid circuit 102. The second pump 150*b* may be disposed upstream of the first pump 150*c* and downstream of the third pump 150*a* along the flow direction of working fluid through the working fluid circuit 102. In one exemplary embodiment, the first pump 150*c* is a circulation pump, the second pump 150*b* is replaced with a compressor, and the third pump 150*a* is replaced with a compressor.

In some examples, the third pump 150*a* is replaced with a first stage compressor, the second pump 150*b* is replaced with a second stage compressor, and the first pump 150*c* is a third stage pump. The second condenser 140*b* may be disposed upstream of the first condenser 140*c* and downstream of the third condenser 140*a* along the flow direction of working fluid through the working fluid circuit 102. In another embodiment, the heat engine system 100 includes three stages of pumps and condensers, such as first, second, and third pump/condenser stages. The first pump/condenser stage may include the third condenser 140*a* fluidly coupled to the working fluid circuit 102 upstream of the third pump 150*a*, the second pump/condenser stage may include the second condenser 140*b* fluidly coupled to the working fluid circuit 102 upstream of the second pump 150*b*, and the third pump/condenser stage may include the first condenser 140*c* fluidly coupled to the working fluid circuit 102 upstream of the first pump 150*c*.

In some examples, the heat engine system 100 may include a variable frequency drive coupled to the first pump 150*c*, the second pump 150*b*, and/or the third pump 150*a*. The variable frequency drive may be configured to control mass flow rate, pressure, or temperature of the working fluid within the working fluid circuit 102. In other examples, the heat engine system 100 may include a drive turbine coupled to the first pump 150*c*, the second pump 150*b*, or the third pump 150*a*. The drive turbine may be configured to control mass flow rate, pressure, or temperature of the working fluid within the working fluid circuit 102. The drive turbine may be the first expander 160*a*, the second expander 160*b*, another expander or turbine, or combinations thereof.

In another embodiment, the driveshaft 162 may be coupled to the first expander 160*a* and the second expander 160*b* such that the driveshaft 162 may be configured to drive a device with the mechanical energy produced or otherwise generated by the combination of the first expander 160*a* and the second expander 160*b*. In some embodiments, the device may be the pumps 150*a*-150*c*, a compressor, a generator 164, an alternator, or combinations thereof. In one embodiment, the heat engine system 100 may include the generator 164 or an alternator coupled to the first expander 160*a* by the driveshaft 162. The generator 164 or the alternator may be configured to convert the mechanical energy produced by the first expander 160*a* into electrical energy. In another embodiment, the driveshaft 162 may be coupled to the second expander 160*b* and the first pump 150*c*, such that the second expander 160*b* may be configured to drive the first pump 150*c* with the mechanical energy produced by the second expander 160*b*.

In another embodiment, as depicted in FIG. 2, the heat engine system 100 may include a process heating system 230 fluidly coupled to and in thermal communication with the low pressure side of the working fluid circuit 102. The process heating system 230 may include a process heat exchanger 236 and a control valve 234 operatively disposed on a fluid line 232 coupled to the low pressure side and under control of the control system 101. The process heat exchanger 236 may be configured to transfer thermal energy from the working fluid on the low pressure side of the working fluid circuit 102 to a heat-transfer fluid flowing through the process heat exchanger 236. In some examples, the process heat exchanger 236 may be configured to transfer thermal energy from the working fluid on the low pressure side of the working fluid circuit 102 to methane during a preheating step to form a heated methane fluid. The thermal energy may be directly transferred or indirectly transferred (e.g., via a heat-transfer fluid) to the methane fluid. The heat source stream 110 may be derived from the heat source 108 configured to combust the heated methane fluid, such as a gas turbine electricity generator.

In another embodiment, as depicted in FIG. 2, the heat engine system 100 may include a recuperator bus system 220 fluidly coupled to and in thermal communication with the low pressure side of the working fluid circuit 102. The recuperator bus system 220 may include turbine discharge lines 170*a*, 170*b*, control valves 168*a*, 168*b*, bypass line 210 and bypass valve 212, fluid lines 222, 224, and other lines and valves fluidly coupled to the working fluid circuit 102 downstream of the first expander 160*a* and/or the second expander 160*b* and upstream of the condenser 140*a*. Generally, the recuperator bus system 220 extends from the first expander 160*a* and/or the second expander 160*b* to the plurality of recuperators 130*a*-130*c*, and further downstream on the low pressure side. In one example, one end of a fluid line 222 may be fluidly coupled to the turbine discharge line 170*b*, and the other end of the fluid line 222 may be fluidly coupled to a point on the working fluid circuit 102 disposed downstream of the recuperator 130*c* and upstream of the condenser 140*a*. In another example, one end of a fluid line 224 may be fluidly coupled to the turbine discharge line 170*b*, the fluid line 222, or the process heating line 232, and the other end of the fluid line 224 may be fluidly coupled to a point on the working fluid circuit 102 disposed downstream of the recuperator 130*b* and upstream of the recuperator 130*c* on the low pressure side.

In some embodiments, the types of working fluid that may be circulated, flowed, or otherwise utilized in the working fluid circuit 102 of the heat engine system 100 include carbon oxides, hydrocarbons, alcohols, ketones, halogenated hydrocarbons, ammonia, amines, aqueous, or combinations thereof. Exemplary working fluids that may be utilized in the heat engine system 100 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 102 of the heat engine system 100, and the other exemplary circuits disclosed herein, may be or may contain carbon dioxide ($CO_2$) and mixtures containing carbon dioxide. Generally, at least a portion of the working fluid circuit 102 contains the working fluid in a supercritical state (e.g., sc-$CO_2$). Carbon dioxide utilized as the working fluid or contained in the working fluid for power generation cycles has many advantages over other compounds typically used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 102 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 102 generally has a high pressure side and a low pressure side and contains a working fluid circulated within the working fluid circuit 102. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the heat engine system 100 or thermodynamic cycle. In one or more embodiments, such as during a startup process, the working fluid is in a supercritical state over certain portions of the working fluid circuit 102 of the heat engine system 100 (e.g., a high pressure side) and in a subcritical state over other portions of the working fluid circuit 102 of the heat engine system 100 (e.g., a low pressure side). In other embodiments, the entire thermodynamic cycle may be operated such that the working fluid is maintained in a supercritical state throughout the entire working fluid circuit 102 of the heat engine system 100.

In embodiments disclosed herein, broadly, the high pressure side of the working fluid circuit 102 may be disposed downstream of any of the pumps 150*a*, 150*b*, or 150*c* and upstream of any of the expanders 160*a* or 160*b*, and the low pressure side of the working fluid circuit 102 may be disposed downstream of any of the expanders 160*a* or 160*b* and upstream of any of the pumps 150*a*, 150*b*, or 150*c*, depending on implementation-specific considerations, such as the type of heat source available, process conditions, including temperature, pressure, flow rate, and whether or not each individual pump 150*a*, 150*b*, or 150*c* is a pump or a compressor, and so forth. In one exemplary embodiment, the pumps 150*a* and 150*b* may be replaced with compressors, the pump 150*c* is a pump, and the high pressure side of the working fluid circuit 102 may start downstream of the pump 150*c*, such as at the discharge outlet of the pump 150*c*, and end at any of the expanders 160*a* or 160*b*, and the low pressure side of the working fluid circuit 102 may start downstream of any of the expanders 160*a* or 160*b* and end upstream of the pump 150*c*, such as at the inlet of the pump 150*c*.

Generally, the high pressure side of the working fluid circuit 102 contains the working fluid (e.g., sc-$CO_2$) at a pressure of about 15 MPa or greater, such as about 17 MPa or greater or about 20 MPa or greater, or about 25 MPa or greater, or about 27 MPa or greater. In some examples, the high pressure side of the working fluid circuit 102 may have a pressure within a range from about 15 MPa to about 40 MPa, more narrowly within a range from about 20 MPa to about 35 MPa, and more narrowly within a range from about 25 MPa to about 30 MPa, such as about 27 MPa.

The low pressure side of the working fluid circuit 102 includes the working fluid (e.g., $CO_2$ or sub-$CO_2$) at a pressure of less than 15 MPa, such as about 12 MPa or less, or about 10 MPa or less. In some examples, the low pressure side of the working fluid circuit 102 may have a pressure within a range from about 1 MPa to about 10 MPa, more narrowly within a range from about 2 MPa to about 8 MPa, and more narrowly within a range from about 4 MPa to about 6 MPa, such as about 5 MPa.

The heat engine system 100 further includes the expander 160*a*, the expander 160*b*, and the shaft 162. Each of the expanders 160*a*, 160*b* may be fluidly coupled to the working fluid circuit 102 and disposed between the high and low pressure sides and configured to convert a pressure drop in the working fluid to mechanical energy. The driveshaft 162 may be coupled to the expander 160*a*, the expander 160*b*, or both of the expanders 160*a*, 160*b*. The shaft 162 may be configured to drive one or more devices, such as a generator or alternator (e.g., the generator 164), a motor, a generator/motor unit, a pump or compressor (e.g., the pumps 150*a*-150*c*), and/or other devices, with the generated mechanical energy.

The generator 164 may be a generator, an alternator (e.g., permanent magnet alternator), or another device for generating electrical energy, such as by transforming mechanical energy from the shaft 162 and one or more of the expanders 160*a*, 160*b* to electrical energy. A power outlet (not shown) may be electrically coupled to the generator 164 and configured to transfer the generated electrical energy from the generator 164 to an electrical grid 166. The electrical grid 166 may be or include an electrical grid, an electrical bus (e.g., plant bus), power electronics, other electric circuits, or combinations thereof. The electrical grid 166 generally contains at least one alternating current bus, alternating current grid, alternating current circuit, or combinations thereof. In one example, the generator 164 is a generator and is electrically and operably connected to the electrical grid 166 via the power outlet. In another example, the generator 164 is an alternator and is electrically and operably connected to power electronics (not shown) via the power outlet. In another example, the generator 164 is electrically connected to power electronics that are electrically connected to the power outlet.

The heat engine system 100 further includes at least one pump/compressor and at least one condenser/cooler, but certain embodiments generally include a plurality of condensers 140*a*-140*c* (e.g., condenser or cooler) and pumps 150*a*-150*c* (e.g., pump or replaced with compressor). Each of the condensers 140*a*-140*c* may independently be a condenser or a cooler and may independently be gas-cooled (e.g., air, nitrogen, or carbon dioxide) or liquid-cooled (e.g., water, solvent, or a mixture thereof). Each of the pumps 150*a*-150*c* may independently be a pump or may be replaced with a compressor and may independently be fluidly coupled to the working fluid circuit 102 between the low pressure side and the high pressure side of the working fluid circuit 102. Also, each of the pumps 150*a*-150*c* may be configured to circulate and/or pressurize the working fluid within the working fluid circuit 102. The condensers 140*a*-140*c* may be in thermal communication with the working fluid in the working fluid circuit 102 and configured to remove thermal energy from the working fluid on the low pressure side of the working fluid circuit 102.

After exiting the pump 150*c*, the working fluid may flow through the waste heat exchangers 120*a*-120*d* and/or the recuperators 130*a*-130*c* before entering the expander 160*a* and/or the expander 160*b*. A series of valves and lines (e.g., conduits or pipes) that include the bypass valves 116*a*-116*d*, the stop or control valves 118*a*-118*d*, the stop or control valves 128*a*-128*c*, and the stop or throttle valves 158*a*, 158*b* may be utilized in varying opened positions and closed positions to control the flow of the working fluid through the waste heat exchangers 120*a*-120*d* and/or the recuperators 130*a*-130*c*. Therefore, such valves may provide control and adjustability to the temperature of the working fluid entering the expander 160*a* and/or the expander 160*b*. The valves may be controllable, fixed (orifice), diverter valves, 3-way valves, or even eliminated in some embodiments. Similarly, each of the additional components (e.g., additional waste heat exchangers and recuperators may be used or eliminated in certain embodiments). For example, recuperator 130*b* may not be utilized in certain applications.

The common shaft or driveshaft 162 may be employed or, in other embodiments, two or more shafts may be used together or independently with the pumps 150*a*-150*c*, the expanders 160*a*, 160*b*, the generator 164, and/or other components. In one example, the expander 160*b* and the pump 150*c* share a common shaft, and the expander 160*a* and the generator 164 share another common shaft. In another example, the expanders 160*a*, 160*b*, the pump 150*c*, and the generator 164 share a common shaft, such as the driveshaft 162. The other pumps may be integrated with the shaft as well. In another embodiment, the process heating system 230 may be a loop to provide thermal energy to heat source fuel, for example, a gas turbine with preheat fuel (e.g., methane), process steam, or other fluids. In one embodiment, the respective shafts 162 may be individual shafts attached (generally bolted together) for concomitant rotation at the same speed.

Figure 4:
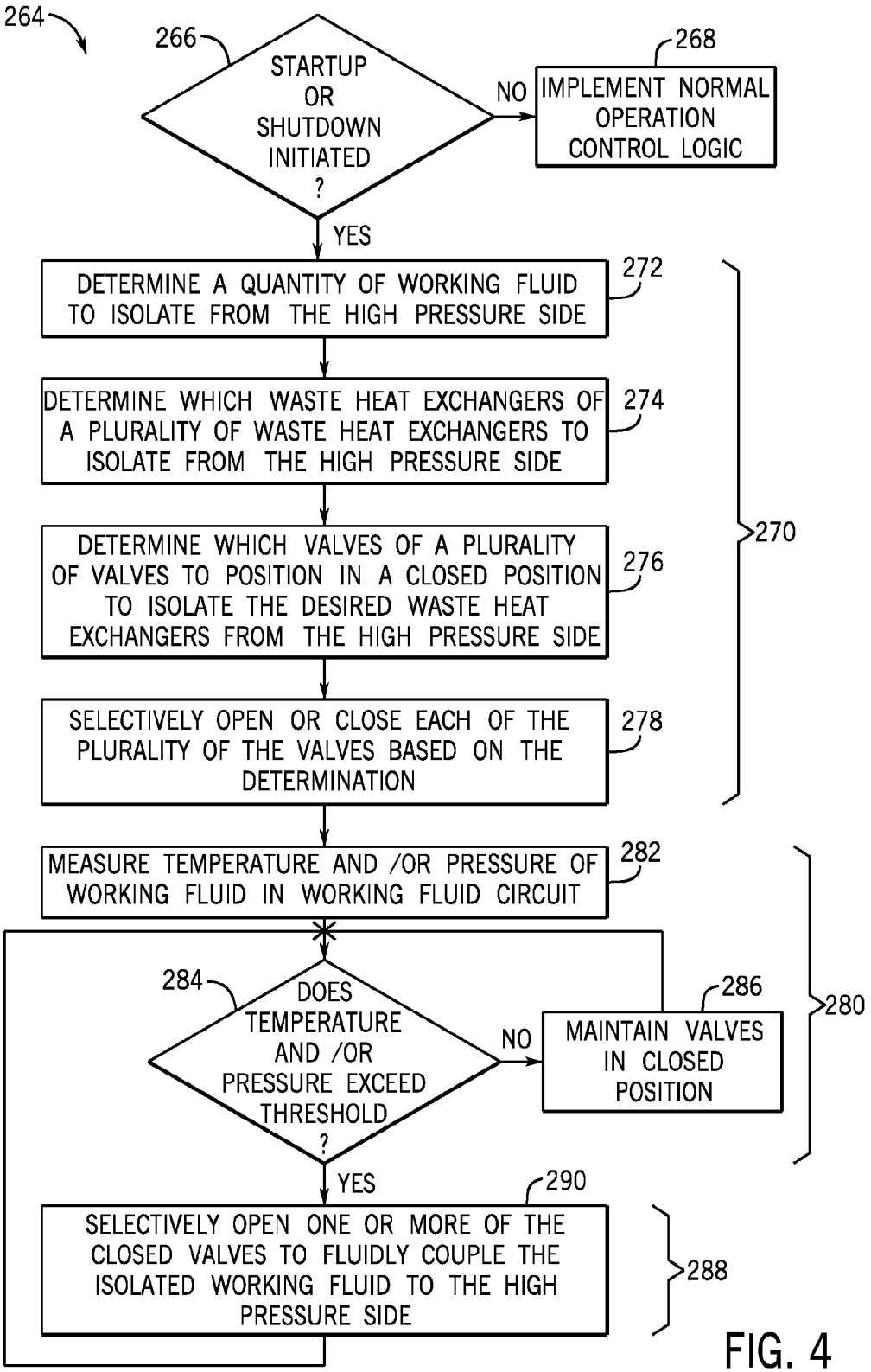
FIG. 4 is a flow chart illustrating a method for controlling the heat engine system illustrated in FIG. 2 during system startup and/or shutdown, according to one or more embodiments disclosed herein.

FIG. 4 illustrates an embodiment of a method 264 that may be utilized by processor 86, or any other suitable processor or controller, to control the heat engine system 100 during startup or shutdown. The illustrated method 264 includes an inquiry as to whether startup or shutdown has been initiated (block 266). If startup or shutdown has not been initiated, then the method 264 includes implementing normal operation control logic (block 268). However, if startup or shutdown has been initiated, the method 264 proceeds to an isolation phase 270. During the isolation phase 270, the processor 86 determines a quantity of working fluid to isolate from the high pressure side (block 272), which waste heat exchangers of a plurality of waste heat exchangers 120*a*-*d* to isolate from the high pressure side (block 274), and which valves of a plurality of valves to position in a closed position to isolate the desired waste heat exchangers from the high pressure side (block 276). Based on such determinations, the processor 86 may selectively open or close each of the plurality of valves (block 278).

That is, during the isolation phase 270, the processor 86 determines which portion of the working fluid circuit 102, which includes the working fluid, to isolate from the flow path of the working fluid flowing through the high and low pressure sides of the selectively configured working fluid circuit 102. In doing so, the processor 86 may effectively isolate piping of the working fluid circuit 102 that contains working fluid at different process conditions (e.g., temperatures, pressures, etc.) than the working fluid flowing through the high and low pressure sides. In some embodiments, the isolated working fluid may subsequently be utilized as a working fluid supply source that is internal to the working fluid circuit 102. By providing an internal working fluid supply source in this way, certain embodiments may reduce or eliminate the need for a storage tank that is external to the working fluid circuit 102.

In the illustrated method 264, an analysis phase 280 may include measuring a temperature and/or pressure of the working fluid in the working fluid circuit 102 (block 282) and inquiring as to whether the measured temperature and/or pressure exceeds a predetermined threshold (block 284). The predetermined threshold may be determined, for example, based on performance data from previous operations of the heat engine system 100, the amount of heat each of the components in the working fluid circuit 102 is rated to handle, and so forth. However, it should be noted that in other embodiments, the analysis phase 280 may include the measurement of or receipt of data indicative of any parameter that indicates process conditions associated with the flow of the working fluid through the working fluid circuit 102. For example, in some embodiments, the temperature and/or pressure of the working fluid may be estimated based on flow parameters, comparison to data acquired from previous operations, and so forth. Indeed, the blocks shown in the analysis phase 280 are meant to illustrate, but not limit, presently contemplated embodiments.

In the illustrated embodiment, if the temperature and/or pressure does not exceed the threshold, the valves that were selectively closed in block 278 are maintained in a closed position (block 286) to maintain a portion of the working fluid isolated from the flow path of the working fluid flowing through the high and low pressure sides. However, if the temperature and/or pressure exceeds the threshold, then the method 264 proceeds to a mitigation phase 288 in which one or more of the closed valves are selectively opened to fluidly couple some or all of the isolated working fluid to the high pressure side (block 290). Once the selected valves are opened, some or all of the isolated working fluid is mixed with the working fluid flowing through the high and low pressure sides. In some embodiments, since the working fluid flowing through the high pressure side is generally at a higher temperature than the isolated working fluid, the selective opening of the valves in block 290 may enable a reduction in the temperature of the working fluid flowing through the working fluid circuit 102 without the need to access an external source. Further, in some embodiments, the method 264 may further include determining the delta between the thresholds and the measured temperature and/or pressure and, based on the magnitude of the delta, determining the quantity of the valves to open. For instance, if the measured temperature and/or pressure are slightly above the threshold, then fewer valves may be opened than if the measured values are greatly above the thresholds.

Referring to the embodiment of the heat engine system 100 shown in FIG. 2, in one example embodiment of the method 264 of FIG. 4, the valves 118*d*, 116*c*, and 116*b* may be selectively closed during the isolation phase 270 to isolate the waste heat exchangers 120*b*, 120*c*, and 120*d* and isolate the working fluid in such waste heat exchangers and the associated piping. Further, as the temperature of the working fluid flowing through the working fluid circuit 102 increases, one or more of the valves 118*d*, 116*c*, and 116*b* may be opened to reduce the temperature of the working fluid flowing through the working fluid circuit 102 and accommodate the increase in pressure without the need to utilize an external storage tank.

For further example, the volume of the working fluid in the waste heat exchangers 120*a*, 120*b*, 120*c*, and 120*d* and the associated piping may be approximately 50% to approximately 70% of the total volume of working fluid in the working fluid circuit 102 in some embodiments. During startup, if the waste heat exchangers 120*b*, 120*c*, and 120*d* are isolated, approximately 30% of the total volume of the working fluid in the working fluid circuit 102 may be isolated from the flow path of the working fluid through the high and low pressure sides. In one embodiment, the average pressure in the heat engine system 100 may be about 10 MPa, the average temperature in the heat engine system 100 may be about 100° C., and the average density in the heat engine system 100 may be about 188.5 kg/m$^3$. If there is approximately 1885 kg of working fluid in the heat engine system 100, and the average temperature increases to approximately 300° C., the average pressure may rise to approximately 19.7 MPa in an isochoric heat addition process (e.g., from 325.7 MJ of heat addition). If the waste heat exchanger 120*b* is then removed from isolation and fluidly coupled to the working fluid flowing through the high and low pressure sides, an additional approximately 10% of working fluid volume may be added to the working fluid flowing through the high and low pressure sides without a mass increase, and the average density would thus become approximately 165 kg/m$^3$. The foregoing volume addition may reduce the average pressure from approximately 19.7 MPa to approximately 17 MPa without removing working fluid mass from the working fluid circuit 102 and pumping it to an external storage tank.

Figure 5:
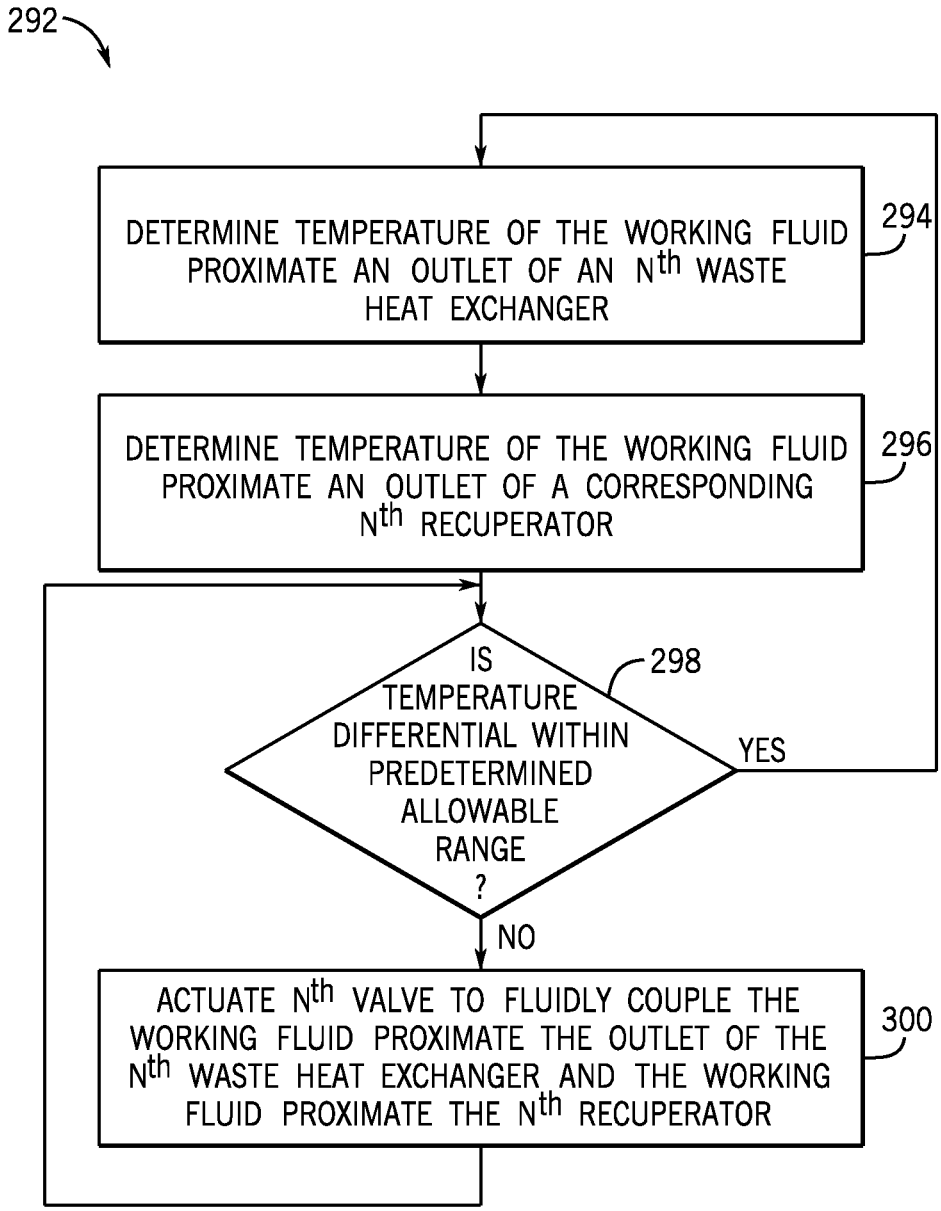
FIG. 5 is a flow chart illustrating a method for controlling the heat engine system illustrated in FIG. 2 during operation, according to one or more embodiments disclosed herein.

FIG. 5 illustrates an embodiment of a method 292 that may be utilized by the processor 86, or any other suitable controller, to control the performance and power output of the heat engine system 100. In this embodiment, the method 292 includes determining a temperature of the working fluid proximate an outlet of an N$^{th}$ waste heat exchanger (block 294) and a temperature of the working fluid proximate an outlet of an N$^{th}$ recuperator (block 296). That is, the method 292 may include determining temperatures proximate the outlets of corresponding waste heat exchangers and recuperators in a selectively configurable working fluid circuit. For example, in the embodiment illustrated in FIG. 2, the waste heat exchanger 120*d* may correspond to the recuperator 130*c*, the waste heat exchanger 120*c* may correspond to the recuperator 130*b*, and the waste heat exchanger 120*b* may correspond to the recuperator 130*a*.

The method 292 further includes inquiring as to whether the difference between the temperature of the working fluid proximate the outlet of the N$^{th}$ waste heat exchanger and the temperature of the working fluid proximate the outlet of the N$^{th}$ recuperator is within a predetermined allowable range (block 298). If the temperature differential is within the predetermined allowable range, then the method 292 proceeds by checking the temperature differentials for each set of corresponding waste heat exchangers and recuperators. However, if the temperature differential is not within the predetermined allowable range, then the method 292 includes actuating an N$^{th}$ valve to fluidly couple the working fluid proximate the outlet of the N$^{th}$ waste heat exchanger and the working fluid proximate the N$^{th}$ recuperator (block 300). For example, in the embodiment of FIG. 2, if the temperature measured proximate the outlet of the waste heat exchanger 120*d* is not approximately equal to the temperature measured proximate the outlet of the recuperator 130*c*, then the valve bypass 116*c* may be actuated to enable mixing between the working fluid in the two measured locations and restore temperature equilibrium.

Figure 6:
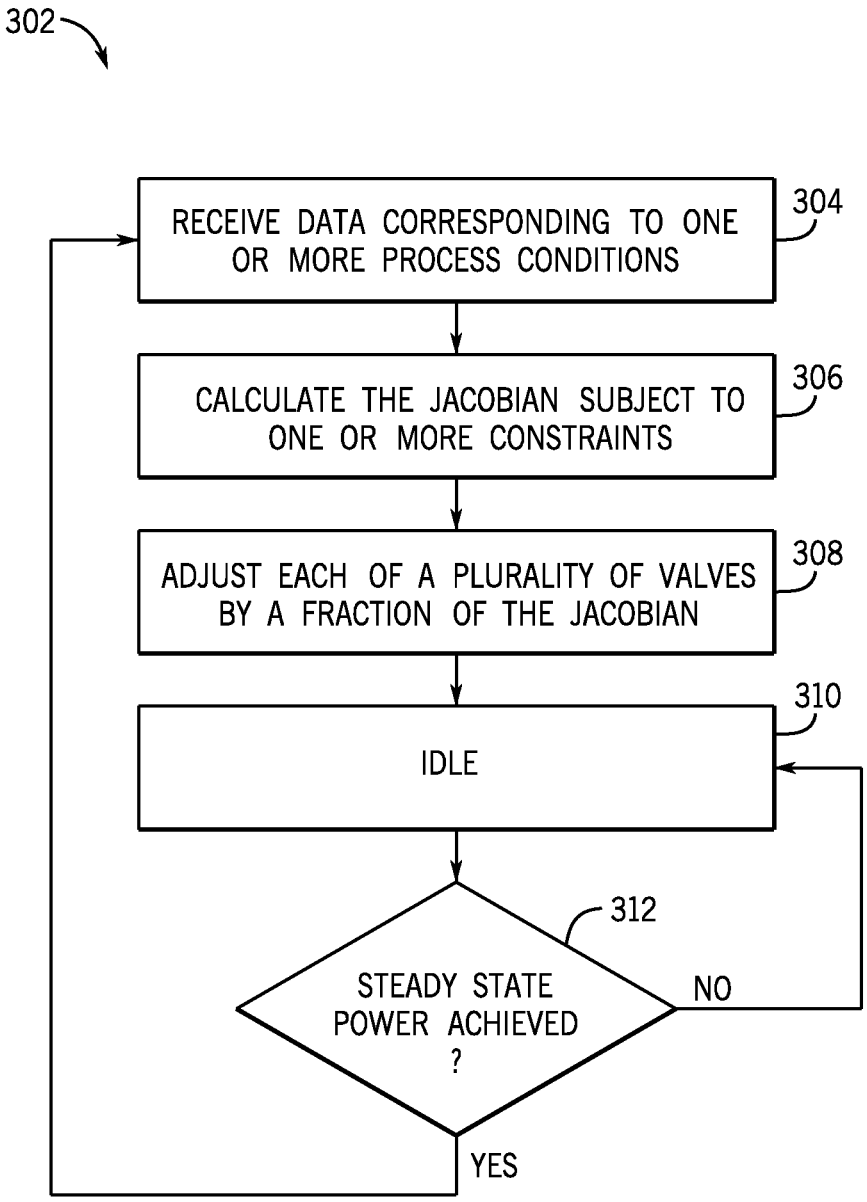
FIG. 6 is a flow chart illustrating a method for controlling the heat engine system illustrated in FIG. 2 to optimize the power output, according to one or more embodiments disclosed herein.

FIG. 6 illustrates an embodiment of a method 302 for controlling the working fluid circuit 102 to maximize power generated by the heat engine system 100. In this embodiment, the processor 86, the valve controller 84, or any other suitable controller, may employ a continuous power maximizing strategy in accordance with the logic of the method 302. More specifically, in such embodiments, the processor 86 may be continuously seeking a higher power output, not limited to a particular set point, throughout operation to maximize the power output of the heat engine system 100 as one or more conditions change during operation.

The method 302 may include receiving data corresponding to one or more process conditions (block 304). The one or more process conditions may include pressures, temperatures, flow rates, and so forth, or any combination thereof. The data may be received, for example, by the valve controller 84 from the process condition sensors 88 and transferred to the processor 86 for calculation of the Jacobian (i.e., the derivatives of the control variables) subject to one or more constraints (block 306). The method 302 also includes adjusting, by a fraction of the Jacobian, each of a plurality of valves that control working fluid flow (block 308). For example, in one embodiment, the valves 116*a*, 118*a*, 116*b*, 118*b*, and 128*a* may be selected as the plurality of valves to be utilized as the control points for the method 302. In such an embodiment, the processor 86 may identify to what degree each of the valves 116*a*, 118*a*, 116*b*, 118*b*, and 128*a* should be partially opened or closed in an attempt to achieve the maximum power output in the quickest manner. Once identified, the processor 86 may communicate the valve adjustments to the valve controller 84, which implements the valve adjustments by selectively actuating each of the valves 116*a*, 118*a*, 116*b*, 118*b*, and 128*a* to achieve the desired valve positioning.

Once the valve adjustments are made, the method 302 includes idling (block 310) and inquiring as to whether the power output of the heat engine system 100 has reached a steady state (block 312). If the power output of the heat engine system 100 has not reached a steady state, then the method 302 remains in the idle state (block 310). However, once the power output of the heat engine system 100 reaches steady state, the method 302 is repeated to attempt to further increase the power output of the heat engine system 100. In this way, the method 302 may be continuously utilized throughout operation of the heat engine system 100 to maximize the power output as one or more process conditions change during operation.

It is to be understood that the present disclosure describes several exemplary embodiments for implementing different features, structures, or functions of the disclosure. Exemplary embodiments of components, arrangements, and configurations are described herein to simplify the present disclosure, however, these exemplary embodiments are provided merely as examples and are not intended to limit the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including", "containing", and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B", unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a pump configured to pressurize and circulate a working fluid through a working fluid circuit having a high pressure side and a low pressure side;

a first expander configured to receive the working fluid from the high pressure side and to convert a pressure drop in the working fluid to mechanical energy;

a plurality of waste heat exchangers disposed in series along a flow path of a heat source stream and each configured to transfer thermal energy from the heat source stream to the working fluid;

a plurality of recuperators, each configured to transfer thermal energy from the working fluid flowing through the low pressure side to the working fluid flowing through the high pressure side;

a plurality of valves, each configured to be positioned in an opened position, a closed position, and a partially opened position; and a valve controller configured to actuate each of the plurality of valves to the opened position, the closed position, or the partially opened position to selectively control whether one or more of the plurality of waste heat exchangers are positioned in the high pressure side and to selectively control whether one or more of the plurality of recuperators are positioned in the high pressure side and the low pressure side.

2. The heat engine system of claim 1, further comprising a processor configured to receive data corresponding to an optimization parameter and, based on the received data, to determine whether to position each of the plurality of valves in the opened position, the closed position, or the partially opened position to selectively control whether one or more of the plurality of waste heat exchangers are positioned in the high pressure side and to selectively control whether to position one or more of the plurality of recuperators are positioned in the high pressure side and the low pressure side.

3. The heat engine system of claim 2, wherein the optimization parameter is a type of heat source providing the heat source stream.

4. The heat engine system of claim 1, wherein the valve controller is further configured to actuate two or more valves of the plurality of valves to position the subset in a closed position to isolate a portion of the working fluid from the working fluid flowing through the high pressure side and the low pressure side.

5. The heat engine system of claim 4, wherein the valve controller is further configured to receive data corresponding to a measured temperature and/or pressure of the working fluid flowing through the high pressure side and/or the low pressure side and to determine if the received data exceeds a predetermined threshold.

6. The heat engine system of claim 5, wherein the valve controller is further configured to selectively actuate one or more of the two or more valves of the plurality of valves to the opened position or the partially opened position if the received data is determined to exceed the predetermined threshold.

7. The heat engine system of claim 1, further comprising one or more process condition sensors configured to determine at least one of a temperature, a pressure, and a flow rate of the working fluid, the process condition sensors communicatively coupled to the valve controller.

8. The heat engine system of claim 7, wherein each of the one or more process condition sensors is configured to measure a temperature of the working fluid, a pressure of the working fluid, a flow rate of the working fluid, or a combination thereof.

9. The heat engine system of claim 7, wherein the valve controller is further configured to receive data corresponding to the at least one of the temperature, the pressure, and the flow rate of the working fluid from the one or more process condition sensors throughout an operation of the heat engine system and to selectively actuate one or more of the plurality of valves to increase a power output of the heat engine system throughout the operation of the heat engine system.

10. The heat engine system of claim 1, further comprising a condenser configured to be in thermal communication with the working fluid on the low pressure side of the working fluid circuit and configured to remove thermal energy from the working fluid on the low pressure side of the working fluid circuit.

11. A method for controlling a heat engine system, comprising:

initiating flow of a working fluid through a working fluid circuit having a high pressure side and a low pressure side by controlling a pump to pressurize and circulate the working fluid through the working fluid circuit;

determining a configuration of the working fluid circuit based on data corresponding to at least one of a temperature, a pressure, and a flow rate of the working fluid;

determining, based on the determined configuration of the working fluid circuit, for each of a plurality of valves, whether to position each respective valve in an opened position, a closed position, or a partially opened position to selectively control whether one or more of a plurality of waste heat exchangers are positioned in the high pressure side of the working fluid circuit and to selectively control whether one or more of a plurality of recuperators are positioned in the high pressure side and the low pressure side of the working fluid circuit;

determining, based on the determined configuration of the working fluid circuit, which of a plurality of valves to position in a closed position to isolate a portion of the working fluid from the working fluid flowing through the working fluid circuit;

receiving data corresponding to a measured temperature and/or pressure of the working fluid flowing through the working fluid circuit;

determining whether the measured temperature and/or pressure exceeds a predetermined threshold; and actuating, if the measured temperature and/or pressure exceeds the predetermined threshold, one or more of the plurality of valves positioned in the closed position to position the one or more of the plurality of valves in an opened position or a partially opened position to enable at least a portion of the isolated portion of the working fluid to flow through the working fluid circuit.

12. The method of claim 11, further comprising actuating a first stop valve to an opened position to enable the working fluid to flow through a first expander and actuating a second stop valve to a closed position to disable the working fluid from flowing through a second expander.

13. The method of claim 11, further comprising actuating a control valve to fluidly couple a process heat exchanger to the low pressure side of the working fluid circuit to enable the transfer of thermal energy from the working fluid to a heat-transfer fluid flowing through the process heat exchanger.

14. The method of claim 13, wherein the heat-transfer fluid comprises methane.

15. A method for controlling a heat engine system, comprising:

initiating flow of a working fluid through a working fluid circuit having a high pressure side and a low pressure side by controlling a pump to pressurize and circulate the working fluid through the working fluid circuit;

determining a configuration of the working fluid circuit based on data corresponding to at least one of a temperature, a pressure, and a flow rate of the working fluid;

determining, based on the determined configuration of the working fluid circuit, for each of a plurality of valves, whether to position each respective valve in an opened position, a closed position, or a partially opened position to selectively control whether one or more of a plurality of waste heat exchangers are positioned in the high pressure side of the working fluid circuit and to selectively control whether one or more of a plurality of recuperators are positioned in the high pressure side and the low pressure side of the working fluid circuit; and actuating each of the plurality of valves to the determined opened position, closed position, or partially opened position.

16. The method of claim 15, wherein determining the configuration of the working fluid circuit further comprises determining whether to position a first expander, a second expander, or both in the working fluid circuit.

17. The method of claim 15, wherein determining the configuration of the working fluid circuit further comprises determining whether to couple a process heat exchanger to the low pressure side of the working fluid circuit.

18. The method of claim 15, further comprising actuating a bypass valve to enable transfer of the working fluid from the low pressure side to the high pressure side.

* * * * *